US008877679B2

(12) United States Patent
Hohberger et al.

(10) Patent No.: US 8,877,679 B2
(45) **Date of Patent: *Nov. 4, 2014**

(54) DIRECT THERMAL MEDIA AND REGISTRATION SENSOR SYSTEM AND METHOD FOR USE IN A COLOR THERMAL PRINTER

(71) Applicant: ZIH Corp., Lincolnshire, IL (US)

(72) Inventors: Clive Hohberger, Highland Park, IL (US); David Womack, McHenry, IL (US); Bruce N. Alleshouse, Wilmette, IL (US); James Clark, Naperville, IL (US); Wolfgang Strobel, Tolland, CT (US)

(73) Assignee: ZIH Corp., Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/791,084

(22) Filed: Mar. 8, 2013

(65) Prior Publication Data

US 2013/0244872 A1 Sep. 19, 2013

Related U.S. Application Data

(63) Continuation of application No. 12/976,205, filed on Dec. 22, 2010, now Pat. No. 8,470,733.

(60) Provisional application No. 61/289,264, filed on Dec. 22, 2009.

(51) Int. Cl.

| | |
|---|---|
| ***B41M 5/34*** | (2006.01) |
| ***B41M 5/323*** | (2006.01) |
| ***B41M 5/48*** | (2006.01) |

(52) U.S. Cl.

CPC ..... *B41M 5/34* (2013.01); *B41M 5/323* (2013.01); *B41M 5/48* (2013.01)

USPC ..... 503/201; 503/204; 503/206

(58) Field of Classification Search

CPC ..... B41M 5/34; B41M 5/323; B41M 5/48

USPC ..... 503/200–226

See application file for complete search history.

(56) References Cited

U.S. PATENT DOCUMENTS

| | | | | |
|---|---|---|---|---|
| 4,710,781 | A | 12/1987 | Stephenson | |
| 4,893,951 | A | 1/1990 | Iwatani et al. | |
| 5,185,315 | A | 2/1993 | Sparer | |
| 5,210,064 | A * | 5/1993 | Shon Baker et al. | 503/201 |

(Continued)

OTHER PUBLICATIONS

"Material Safety Data Sheet", Jan. 11, 2010.*

*Primary Examiner* — Bruce H Hess

(74) *Attorney, Agent, or Firm* — Alston & Bird LLP

(57) ABSTRACT

Provided is a direct thermal media containing a regular repeating pattern of color-forming thermally-imageable stripes printed parallel to the print head element line and a system for using such direct thermal media in color direct thermal printers including an optical registration system optimized for use with this media and an image processing unit that monitors the position of the stripe pattern relative to the print head and synchronizes the start of the printing process. This direct thermal media together with the optical registration system and image processing unit comprise an operative system in that the design of the thermal media, the optical registration system and image processing unit used to control printing are optimized for use with each other. This system may be utilized, for example, in color thermal printers for documents, receipts, tags, tickets or labels.

15 Claims, 15 Drawing Sheets

(56) References Cited

U.S. PATENT DOCUMENTS

| | | | | |
|---|---|---|---|---|
| 5,644,352 | A | 7/1997 | Chang et al. | |
| 5,739,835 | A | 4/1998 | Morgavi et al. | |
| 5,755,519 | A | 5/1998 | Klinefelter | |
| 5,883,043 | A * | 3/1999 | Halbrook et al. | 503/204 |
| 6,448,991 | B1 | 9/2002 | Doan | |
| 7,842,445 | B2 * | 11/2010 | Riley et al. | 430/108.2 |

* cited by examiner

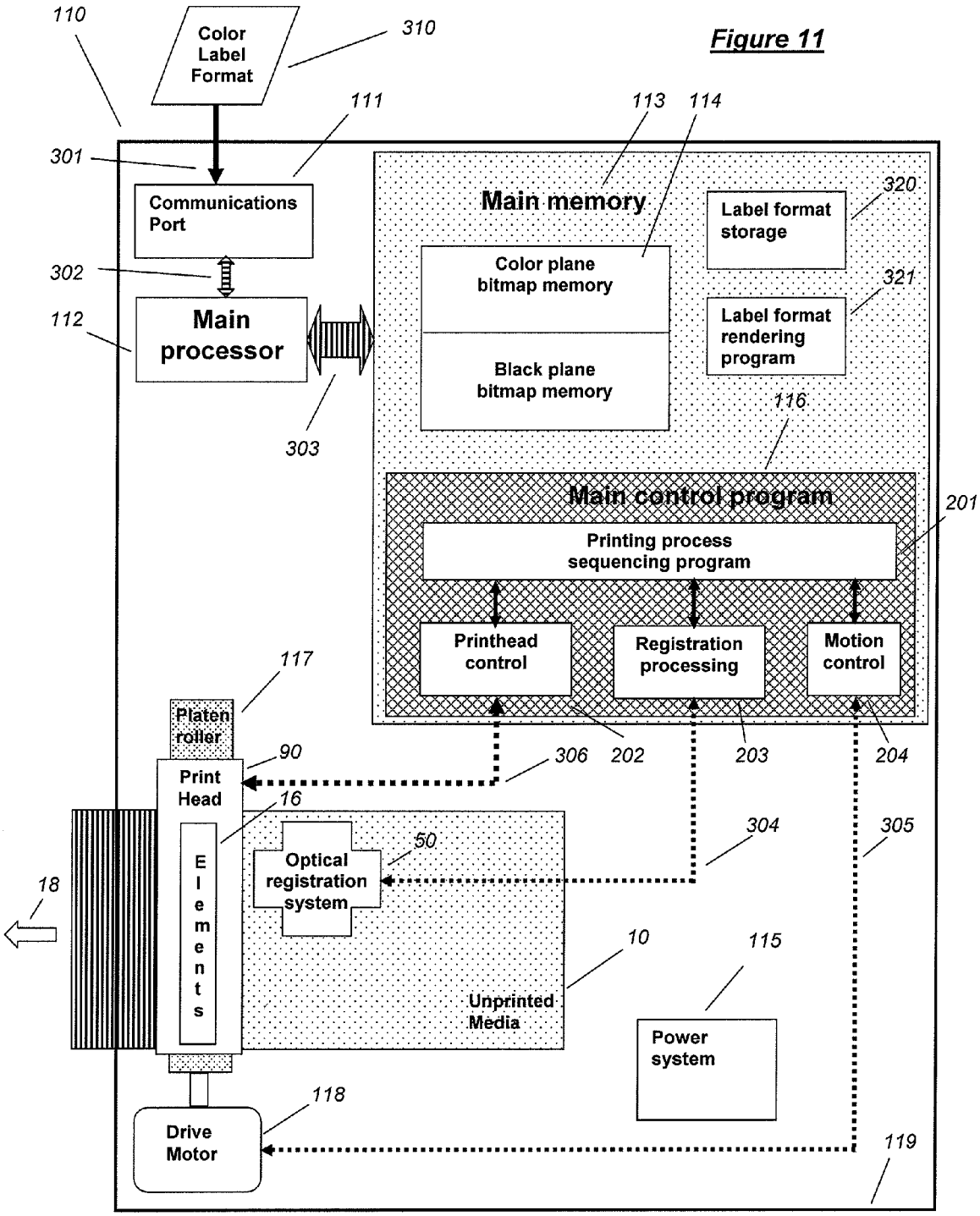
Figure 11
110
Color Label Format
310
111
113
114
301
Communications Port
Main memory
320
Label format storage
302
Color plane bitmap memory
321
112
Main processor
Label format rendering program
Black plane bitmap memory
303
116
Main control program
201
Printing process sequencing program
Printhead control
Registration processing
Motion control
117
Platen roller
90
306
202
203
204
Print Head
16
304
305
50
Optical registration system
18
Elements
10
115
Unprinted Media
Power system
118
Drive Motor
119

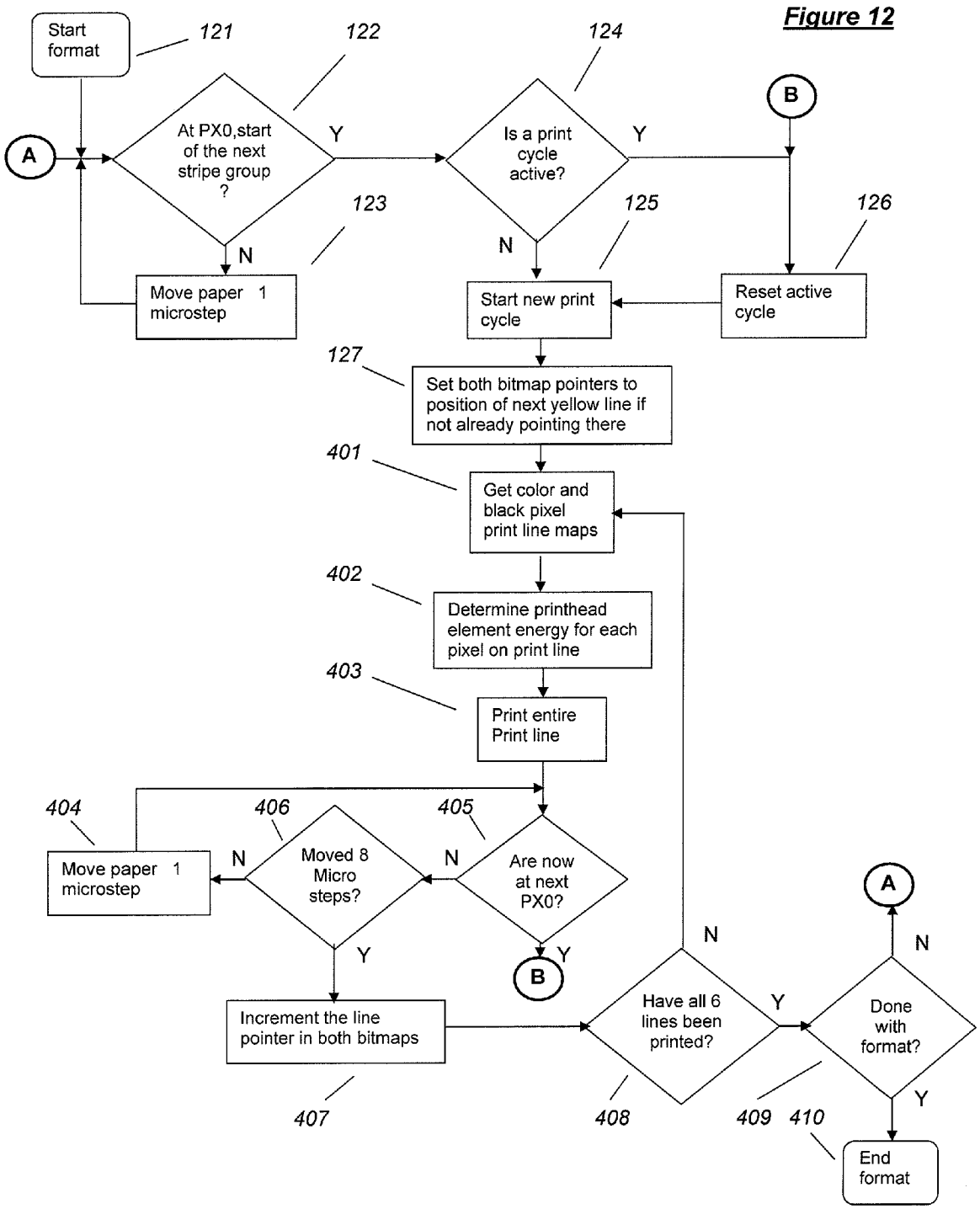
Figure 12
Start format
121
122
124
A
At PX0,start of the next stripe group ?
Y
Is a print cycle active?
Y
B
123
125
126
N
N
Move paper 1 microstep
Start new print cycle
Reset active cycle
127
Set both bitmap pointers to position of next yellow line if not already pointing there
401
Get color and black pixel print line maps
402
Determine printhead element energy for each pixel on print line
403
Print entire Print line
404
406
405
Move paper 1 microstep
N
Moved 8 Micro steps?
N
Are now at next PX0?
A
N
N
Y
Y
B
Increment the line pointer in both bitmaps
Have all 6 lines been printed?
Y
Done with format?
Y
407
408
409
410
End format

150

152

DIRECT THERMAL MEDIA AND REGISTRATION SENSOR SYSTEM AND METHOD FOR USE IN A COLOR THERMAL PRINTER

CROSS-REFERENCE TO RELATED APPLICATIONS

This application is a continuation and claims the benefit of U.S. patent application Ser. No. 12/976,205, filed Dec. 22, 2010, which claims priority U.S. Provisional Application No. 61/289,264, filed Dec. 22, 2009, both of which are incorporated by reference herein in their entireties.

TECHNOLOGICAL FIELD

This invention relates to a direct thermal media containing a regular repeating pattern of color-forming thermally-imageable stripes parallel to the print head element line and a system and method for using such a direct thermal media in color direct thermal printers including an optical registration system optimized for use with this media and an image processing unit that monitors the position of the stripe pattern relative to the print head and synchronizes the printing process.

BACKGROUND

Various types of printing methods, mechanisms, and delivery technologies have been developed for applying ink to various print media, such as paper and cards, or otherwise forming printed indicia on print media. One method is thermal print media. Another method is the use of ribbons with multiple color dyes for color printing onto separate print media. A problem that must be addressed when using ribbons with multiple color dyes for color printing is aligning each series of a repeating pattern of the color dyes with the print head. Various methods have been used to address this problem, such as using a sensitometer, a code field, various light sources, and holes or markings on the ribbon substrate. However, improved and more functionally sophisticated print media and methods to align repeating patterns for color printing with a thermal print head are desirable.

BRIEF SUMMARY

This invention relates to a direct thermal media containing a regular repeating pattern of color-forming thermally-imageable stripes parallel to the print head element line and a system and method for using such a direct thermal media in color direct thermal printers including an optical registration system optimized for use with this media and an image processing unit that monitors the position of the stripe pattern relative to the print head and synchronizes the printing process.

This direct thermal media together with the optical registration system and image processing unit collectively comprise an operative system according to an embodiment of the present invention wherein the design of the thermal media, the optical registration system, and image processing unit used to control printing are optimized for use with each other. This system may be used, for example, in a color thermal printer for creating items such as documents, receipts, tags, tickets, wristbands, cards, labels or RFID smart labels. While this description describes label formatting as an exemplary embodiment, it is equally applicable to formatting and printing any such items.

Provided are embodiments of systems for use in the color direct thermal printer including a laterally striped direct thermal media comprising a repeating alternating pattern of at least 2 sets of stripes wherein each stripe set contains a thermochromic leuco dye producing one color when thermally imaged and each of the other stripe sets contain a thermochromic leuco dye producing a unique and different color when thermally imaged, and wherein one stripe set also contains a fluorophore and is fluorescent under excitation light of a defined wavelength range; an optical registration system configured to correspond with the optical properties of the fluorophore and comprising a confocal excitation light source configured to cause the fluorophore carrying stripe to fluoresce with an anamorphic optical return path to filter and focus the emitted fluorescence light pattern by the fluorescent stripe as an image on an a sensor; and an image processing unit configured to determine the position of each fluorescent stripe on the array sensor and configured to output a signal when a fluorescent stripe is detected at a predetermined position on the array sensor.

A flood coat of a black image forming leuco dye may be uniformly flood coated on the direct thermal media prior to printing the color-forming stripe sets and the activation temperature of the black image forming leuco dye is sufficiently high that little or no activation of the black image forming leuco dye underlayer occurs when the printed stripes are imaged at a static temperature to 90% of their saturated optical density.

The system may use an optical registration system including a solid state sensor for edge position detection of single stripe, such as a linear CMOS or CCD imaging sensor having at least 128 pixels as the sensor. Or the system may use an optical registration system including a solid state array sensor for edge position detection of multiple stripes, such as a two-dimensional CMOS or CCD imaging sensor having at least 65,536 pixels as the array sensor. The optical registration system may be configured with an anamorphic optical return path to filter and focus the emitted fluorescence light pattern by the fluorescent stripes as an image on the array sensor and configured with a magnification in one axis along the sensor >1.00 in absolute value and a magnification in the orthogonal sensor axis <1.00 in absolute value.

Two optical registration systems may be utilized in tandem with a common image processing unit, and the two optical registration systems may be spaced apart both along and across the media web, such as for continuity of registration control across holes in the media or gaps between die cut labels, or such as for measurement of media skew. A system may be configured to use the measurement of media skew to rotate the print head line to eliminate skew by aligning the print head line with the media stripes. Alternatively, one addition, a system may use the measurement of media skew to rotate the media transport system to eliminate skew by aligning the media stripes with the print head line. Similarly, a system may use in the measurement of media skew to delay the firing of each print head element or a group of print head elements until the skew stripe is near or directly under that element or group of print head elements.

Also provided are embodiments of direct thermal media with a repeating pattern of two or more stripes which, when thermally imaged, display different human visible colors and at least one stripe of which contains a fluorescing material. At least one of the stripes may contain both a blessing material and immaterial which changes from not human visible to human visible under heat. The repeating pattern of stripes may be printed over one or more continuous flood coated layers of material, and at least one of those flood coated layers may locally change from not human visible to human visible under local heating. A flood coated thermal barrier coating may be applied between the repeating pattern of stripes and the flood coated layer that changes from not human visible to human visible, and the thermal barrier coating may be configured to cause the flood coated layer to be imaged with a thermal print head and a higher required energy per area than the stripes or to be imaged at a higher static temperature than the stripes.

Also provided are embodiments of methods of manufacturing a direct thermal media comprising providing a repeating alternating pattern of at least 2 sets of stripes, each set of stripes comprising at least two stripes, wherein at least one stripe in each set of stripes comprises a thermally active dye producing an optically detectable permanent change in the media when thermally imaged, and wherein at least one stripe in each set of stripes comprises a fluorophore that is fluorescent under excitation light of at least one defined wavelength. A method may also comprise flood coating a layer that changes from not human visible to human visible, flood coating on top of it a thermal barrier coating causes the flood coated layer below to be imaged with a thermal print head at a higher required energy per dot area than the stripes, providing a repeating alternating pattern of at least 2 sets of stripes, each set of stripes comprising at least two stripes, wherein at least one stripe in each set of stripes comprises a thermally active dye producing an optically detectable permanent change in the media when thermally imaged, and wherein at least one stripe in each set of stripes comprises a fluorophore that is fluorescent under excitation light of at least one defined wavelength.

Additional systems, methods of use, and methods of manufacture are provided that relate to thermal printing, use of direct thermal media in color direct thermal printers including an optical registration system and an image processing unit that monitors the position of the stripe pattern relative to the print head to synchronize the printing process, and methods of manufacturing such direct thermal media. These and other embodiments of the present invention are described further below.

BRIEF DESCRIPTION OF THE DRAWINGS

FIG. 11 is a schematic block diagram of a thermal printer using a direct thermal media registration system of an embodiment of the present invention.

FIG. 12 is a block diagram of a printing sequence program according to them by the present invention.

DETAILED DESCRIPTION

Embodiments of the present invention now will be described more fully hereinafter with reference to the accompanying drawings, in which some, but not all embodiments are shown. Indeed, these embodiments may be embodied in many different forms and should not be construed as limited to the embodiments set forth herein; rather, these embodiments are provided so that this disclosure will satisfy applicable legal requirements. Like numbers refer to like elements throughout.

Media

Figure 1:
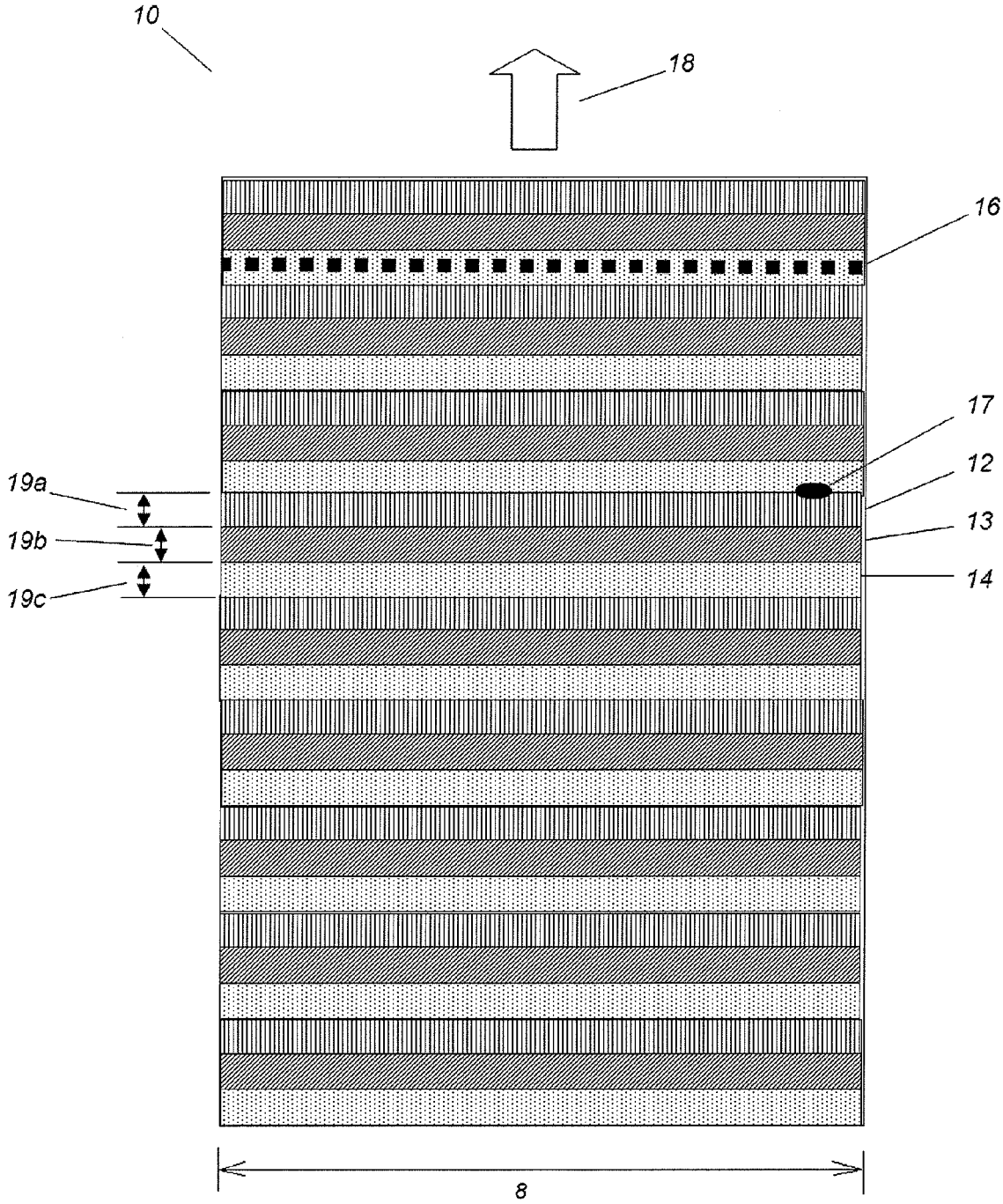
FIG. 1 is a diagram of a laterally striped direct thermal media according to an embodiment of the present invention.

FIG. 1 shows a laterally striped direct thermal media 10 of an embodiment of the present invention having a regular pattern of stripe sets 12, 13, and 14, with respective constant breadths 19*a*, 19*b* and 19*c*, the stripe breadth measured in direction 18. The extent 8, such as applied to stripes 12, 13 and 14, refers to measurements in the orthogonal direction to 18 across the width of the media 10.

Embodiments of the present invention may use at least one stripe that contains materials which changes from not human visible to human visible under heat, such as from local heating of the stripe. A thermal flood coating may also be used with at least one heat-sensitive stripe to create a thermal barrier for the stripe and require higher energy per dot area than other heat-sensitive stripes. For example, each stripe 12, 13 and 14 may contain a transparent leuco dye configured to undergo a thermochromic reaction and change color when imaged by the heat from a thermal print head. In the illustrated embodiment, each stripe 12 contains a yellow-producing dye; each stripe 13 a magenta-producing dye; and each stripe 14 a cyan-producing dye. One color of stripe, here the yellow-producing stripes 12 also contains a fluorophore, which absorbs excitation light in one wavelength range and fluoresces in a longer wavelength range. Excitation light may be provided from an excitation light source such as a solid state laser or light emitting diode with various emission wavelengths, such as below 400 nm. In other embodiments, and depending on the choice and visual color of the fluorophore, the fluorophore itself may additionally or alternatively be added to the magenta-producing stripes 13 or the cyan-producing stripes 14. Alternate embodiments of direct thermal media may use different colors, brightnesses, decay patterns, shades, tints, or other properties based upon the electromagnetic spectrum to differentiate stripes. Alternate embodiments of direct thermal media may use a different number of stripes in the pattern of a stripe set. Alternate embodiments of direct thermal media may include a fluorophore in any one of the stripes in the stripe set, as described above. Alternate embodiments of direct thermal media may include a fluorophore in more than one and less than all of the stripes in the stripe set. Alternate embodiments of direct thermal media may use more than one fluorophore in a single stripe or multiple stripes in a stripe set, thereby creating a detectable fluorophore pattern and/or allowing for different excitations of the fluorophores in the stripe(s) using different wavelengths. Alternate embodiments of direct thermal media may even use a pattern in the stripe sets where at least one stripe has a different breadth or extent than other stripes in the stripe set, so long as the pattern is a regular repeating pattern known by the optical registration system and the image processing unit.

In operation, the direct thermal media 10 moves in direction 18 past a direct thermal print head element line 16. The firing of the thermal print head elements is synchronized by an optical registration system 17 mounted in the media path either before or after the print head path. The optical registration system 17 is shown in FIG. 1 as mounted before the media flows under the print head element line 16, detecting the leading edge of a fluorescent yellow stripe 12. The optical registration system 17 both activates the fluorophore using an excitation light source light and detects the fluorescence of stripes 12. This optical registration system 17 can be of many forms, including a very small edge-detecting sensor or an imaging sensor having a plurality of high resolution sensor pixels, as long as the result is that the position of each fluorescent yellow stripe as it passes under print head element line 16 is precisely known within a small fraction of the breadth of stripe 12. An edge-detecting sensor may be, for example, a solid state sensor for edge position detection of a single stripe, such as a fluorescent yellow stripe 12. Similarly, an edge-detecting sensor may be, for example, a solid state array sensor for edge position detection of multiple stripes.

Anamorphic Optical System

In one exemplary embodiment, the leuco-dye laterally-striped thermal media may be produced through commercial printing methods, such as flexographic or gravure printing. In the preparation of the media, printing defects, such as varying line breadths, fluorophore concentration, whiteness of media, ink drop-outs and voids, may cause apparent differences in stripe fluorescence. In a well-designed registration system, increasing the lateral field of view of the optical registration system 17 along each fluorescent yellow stripe 12 may average out these fluorescence changes due to printing defects and artifacts over a longer stripe extent, making the viewed fluorescence signal more uniform from each fluorescent yellow stripe 12.

Figure 2:
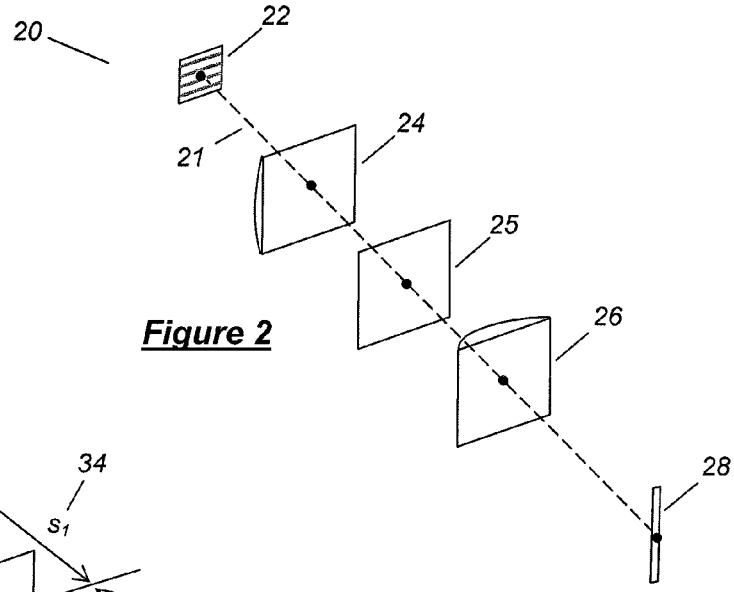
FIGS. 2-4 are diagrams of an anamorphic florescent imaging system.

FIG. 2 shows an exemplary anamorphic fluorescence imaging system 20 which may be used as fluorescence detector 17 according to an embodiment of the present invention. Object 22 represents a rectangular field of view on thermal media 10 in FIG. 1. The object 22 has a size in the vertical direction that includes, for example, 4 complete sets of stripes 12, 13 and 14, so that 4 fluorescent yellow stripes 12 always appear in 22. Increasing the extent of the stripes comprising object 22 in the horizontal direction enables optical averaging of the fluorescent emission along each fluorescent yellow stripe 12, to help minimize the effects of any imperfections that may have resulted during the preparation of the media 10.

In the illustrated embodiment of the exemplary anamorphic fluorescence imaging system 20, perpendicularly crossed cylindrical lenses 24 and 26 are used to project the object 22 onto a CMOS or CCD linear imaging sensor 28. Sensor 28 may be long and narrow. CMOS or CCD linear imaging sensors may have at least 256 square 14 μm pixels for a total sensor length of 3.58 mm shown here in the vertical direction, and each pixel has a width of 14 μm in the horizontal direction. Alternate embodiments may include one-dimensional CMOS or CCD sensors having at least 128 pixels or a two-dimensional CMOS or CCD imaging sensor having at least a 65,536 pixel array.

In this explanatory example, the object 22 has a height of 1.084 mm, in which may fit 4.267 3-stripe cycles with a constant stripe breadth for all stripes of a=1/300 inch=0.0847 mm, and the extent of the object 22 along the stripes is as large as practical. An optical filter window 25, which may be an optical bandpass, longpass, or dichroic filter, may be included to admit the fluorescence light wavelengths but exclude the wavelengths of light used to excite the fluorescence, as well as any stray light.

Figure 3:
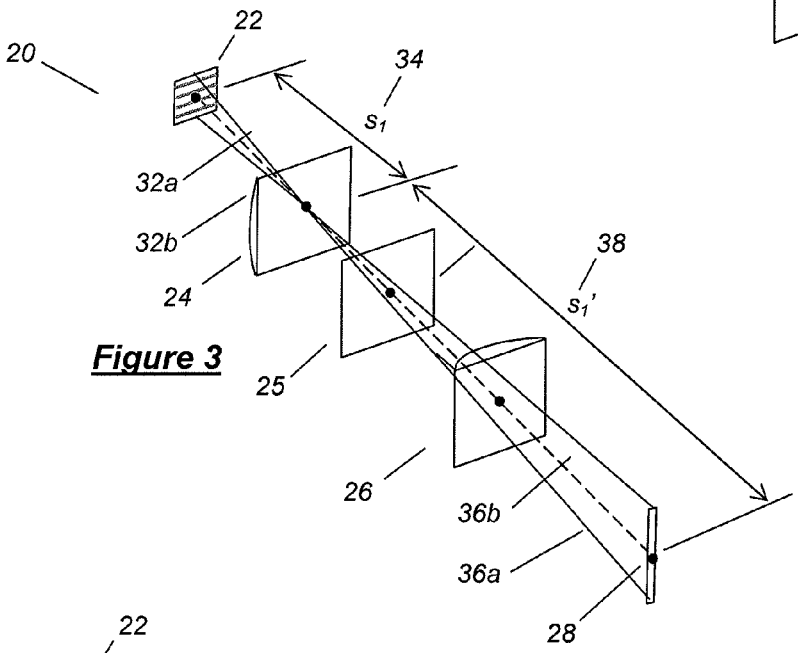
Figure 4:
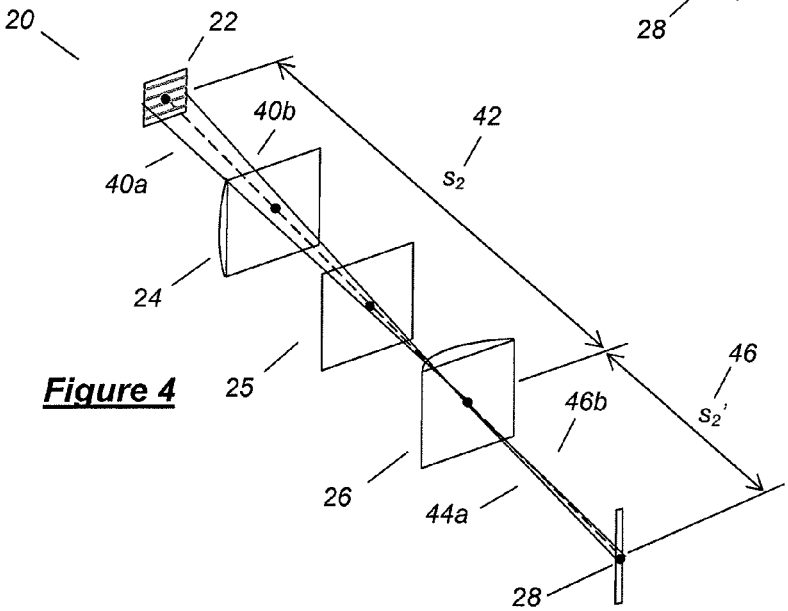

Cylindrical lenses 24 and 26 are designed for applications requiring one-dimensional shaping of the beam from a light source. In FIGS. 2, 3, and 4 cylindrical lens 24 refracts light only along the vertical axis and cylindrical lens 26 refracts light only along the horizontal axis. This allows the design of the anamorphic fluorescence imaging system 20 to proceed independently in the vertical and horizontal axes.

In FIG. 3, the 1.084 mm vertical pattern of object 22 is projected on to a 256 pixel CMOS or CCD linear imaging sensor 28, which here has 256×1 pixels each 0.014 mm square, for a sensor length of 3.584 mm and a sensor width of 0.014 mm. To project the 1.084 mm high object 22 onto the long axis of the sensor 28 requires a magnification of 3.31×. Each square pixel in sensor 28 sees (4.267 ×3a)/256=0.05a in object 22 height.

To minimize the effects of optical aberrations, the exemplary system was designed at approximately f/10 in the vertical axis. Cylindrical lenses 24 and 26 have an effective focal length of $f_1$=40 mm and $f_2$=10 mm respectively, with a lens aperture of width of 4 mm and of cylinder length of 8 mm, and have an appropriate antireflective coating.

In FIG. 3, for lens 24 to produce a vertical magnification $m_1$=−3.31 (the negative sign implying the image is inverted), the image distance $s_1'$ 38 must be 3.31 times the object distance $s_1$ 34. Using standard thin lens approximation formulae based on Gauss's equation, $$s_1 = \frac{f_1(1-m_1)}{m_1} = \frac{40(1-(-3.31))}{-3.31} = -52.1 \text{ mm} \tag{1}$$

$$s_1' = f_1(1-m_1) = 40(1-(-3.31)) = 172.4 \text{ mm} \tag{2}$$

$$s_1' - s_1 = 224.5 \text{ mm} \tag{3}$$

In FIG. 3, the total spacing between object 22 and the linear imaging sensor 28 is 224.5 mm using the thin lens design approximation.

The horizontal magnification is constrained to keep this identical 224.5 mm spacing between object 22 and linear imaging sensor 28 in FIG. 4. Using the same cylinder lens type with focal length $f_2$=10 mm for lens 26, a horizontal image field of 0.014 mm wide on linear imaging sensor 28 is to be produced, given the extent of the stripes in the object 22 as a free variable, b. The magnification, $m_2$, required is negative less than 1 in magnitude, and given by $$m_2 = -\frac{0.014}{b} \tag{4}$$

The placement of lens 26 is found by solving for $s_2$ 42 and $s_2'$ 46 in terms of b using equations (1) and (2). Given the constraint that $(s_2'-s_2)=(s_1'-s_1)$=224.5 mm from equation (3), $$s_2' - s_2 = f_2(1-m_2) - \frac{f_2(1-m_2)}{m_2} = 224.5 \text{ mm} \tag{5}$$

Using $f_2$=10 mm, and factoring out (1-$m_2$) then equation (5) can be rewritten only in terms of $m_2$ $$(1-m_2)\left(1-\frac{1}{m_2}\right)=22.54 \tag{6}$$

It is known that $m_2$ is both negative and has a magnitude <1. Let E be the error in $$E=(1-m_2)\left(1-\frac{1}{m_2}\right)=22.54 \tag{7}$$

Values of $m_2$ were simply iterated by −0.001 over the range 0 to −1 until E→0. It was quickly found $$m_2=-0.049$$

$$b=0.29\text{ mm} \tag{8}$$

The horizontal field of view, b, is about 3.4a, the extent of the object 22 along the stripes is about 3.4 times the stripe breadth, a. As a result so each 0.014 mm square pixel integrates a rectangular image area in object 22 which is 0.05a high by 3.4a wide. This minimizes the impact of local printing or manufacturing defects in printing fluorescent yellow stripes 12 affecting their fluorescence signal. Solving now for the values of $s_2$ and $s_2'$ $$s_2=\frac{f_2(1-m_2)}{m_2}=\frac{10(1-(-0.049))}{-0.049}=-214.1\text{ mm} \tag{9}$$

$$s_2'=f_2(1-m_2)=10(1-(-0.049)=10.5\text{ mm} \tag{10}$$

This completes the exemplary design of an anamorphic optical system 20 according to an embodiment of the present invention for registration control using laterally striped direct thermal media 10.

Exemplary Direct Thermal Media and Registration Sensor System

An exemplary embodiment of a direct thermal media and registration sensor system includes direct thermal media that forms an operative system together with the optical registration system and image processing unit, wherein the design of the thermal media, the optical registration system, and the image processing unit used to control printing are all optimized for use with each other.

The media embodiment in FIG. 1 shows a laterally striped direct thermal media 10 having a regular printed pattern stripes 12, 13, and 14 of equal and constant breadth and extent where each stripe contains a transparent thermal dye producing a different color when imaged by a thermal print head. The dyes and stripes will be referred to hereafter by the colors they produce when imaged. In this embodiment, each stripe 12 contains a yellow dye; each stripe 13 a magenta dye; and each stripe 14 a cyan dye. As may be seen in the graph of dynamic thermal response 150 in FIG. 15, the cyan, yellow and magenta dyes (see figure legend 152) may be prepared so that each color images to the same relative color density at the same value of electrical energy $E_c$ input to each print head dot, as measured on a 300 dpi Atlantek Model 200 thermal paper tester using a test method such as ASTM F1405 or similar for dynamic thermal response testing.

Figure 15:
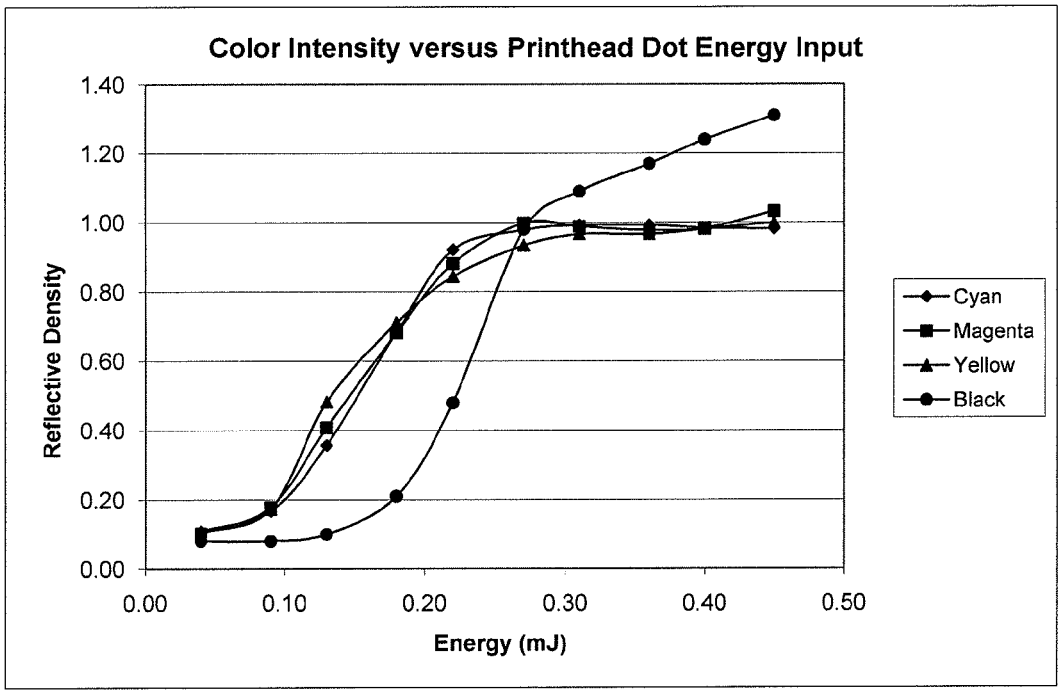
FIG. 15 is a graph of dynamic thermal response.

Optionally, a flood coat of a black forming leuco dye may be uniformly flood coated on the direct thermal media 10 prior to printing stripes 12, 13 and 14. The nominal image density versus energy/dot input $E_b$ for the black leuco dye may be shifted right in FIG. 15 by either a chemistry modification, such as raising the melting point of the developer component of the black thermal dye coating, and/or by adding a thermal barrier coating between the layer of black forming leuco dye and the pattern of color-forming stripes above it. This thermal barrier coating raises the energy per dot required to activate the black dye layer enough that the color inks can be activated at some energy/dot which only produces negligible activation of the black dye layer. FIG. 15 shows the dynamic thermal response 150 of the cyan, magenta, yellow and black leuco dye coatings (see legend 152) used in the exemplary embodiment.

When the energy per dot of print element 16 is sufficiently high that black dye is thermally activated, the colored dye above it is also activated; however the optical density of the black dye is such that it absorbs virtually all the incident light and the net appearance of the thermal image is black to the eye. Each printed element in each stripe may therefore be visually white (unimaged), color imaged, or black imaged.

In the exemplary embodiment, each yellow stripe 12 also contains a selected fluorophore (for example, Pigment D034 from Day-Glo Color Corporation, Cleveland, Ohio) with a peak emission wavelength in the range of sensitivity of the registration sensor, nominally 507 nm and a secondary peak excitation wavelength around 345 nm, where it is excited by a 365 nm UV LED. Each stripe 12, 13, and 14 is 1/300 inch=0.0847 mm in breadth so that the repeat distance between consecutive fluorescent yellow stripes 12 is 0.0100 inches or 0.254 mm.

Figure 5:
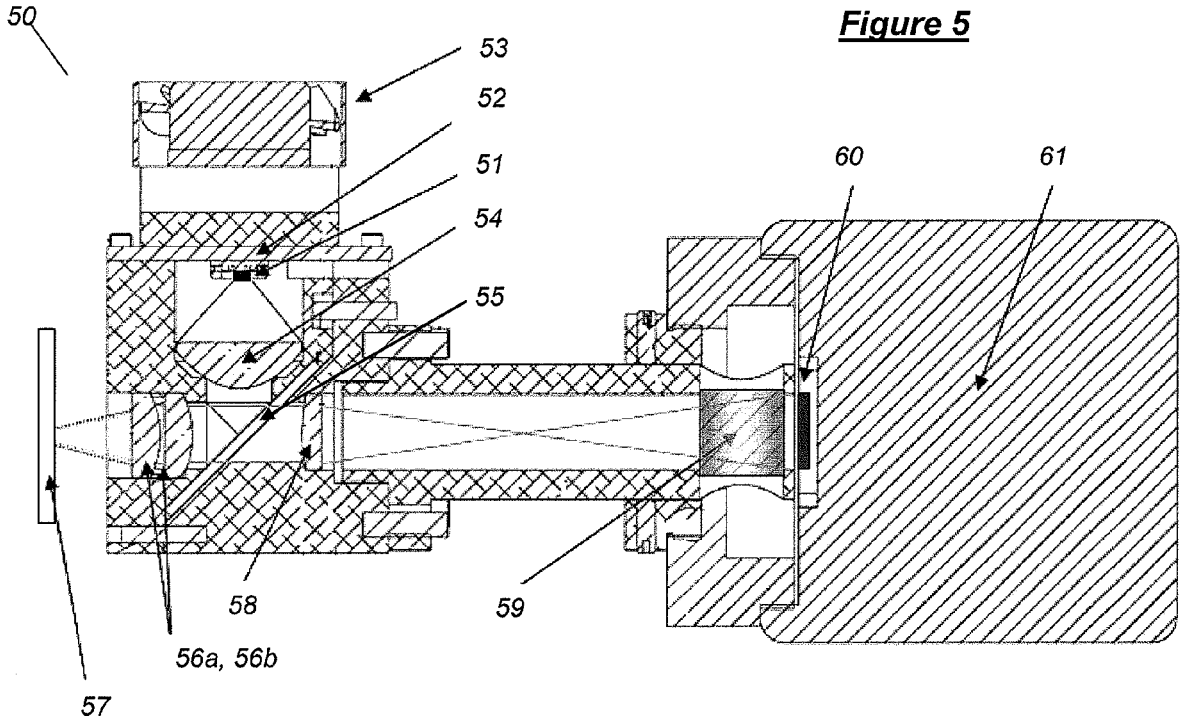
FIG. 5 is a diagram of an anamorphic optical system for use in registration control according to an embodiment of the present invention.

The direct thermal media 10 may be utilized in a thermal printer together with an embodiment of an optical registration system 50, shown in FIG. 5. The design of the optical registration system 50 has been optimized around the optical properties of the chosen Day-Glo D034 fluorophore in the direct thermal media 10; conversely, high-quality performance of the registration control system 50 requires a choice of base paper and constituent chemicals in the direct thermal media 10 that are preferably free of any optical brighteners typically used in the manufacture of white paper, film, cardstock, and some inks.

FIG. 5 shows the optical layout of an exemplary embodiment of an anamorphic optical system 50 of the present invention for use in registration control. The anamorphic optical registration system integrates the UV light source and the visible light fluorescence linear imaging sensor in a common optical system. Central to the design of the system is the use of a dichroic beam splitter and a confocal optical path from the dichroic beam splitter for light passing to and from the imaged area on the media.

A surface mounted 365 nm UV LED 51 is mounted on a thermally-conductive metal core PC board 52, the other side of which may be attached to a finned heat sink and fan assembly 53 used to cool the LED 51. A large numerical aperture aspheric lens 54 collects the LED light and outputs as a parallel beam.

A dichroic beam splitter 55 mounted at 45° to the parallel beam of LED light is designed to reflect wavelengths below 450 nm and transmit wavelengths above 450 nm. The incident parallel 365 nm light beam is reflected at 90° and passes through planoconvex lenses **56*a* and 56*b* to form a spot approximately 2 mm in diameter on fluorescent striped media 57**.

Figure 6:
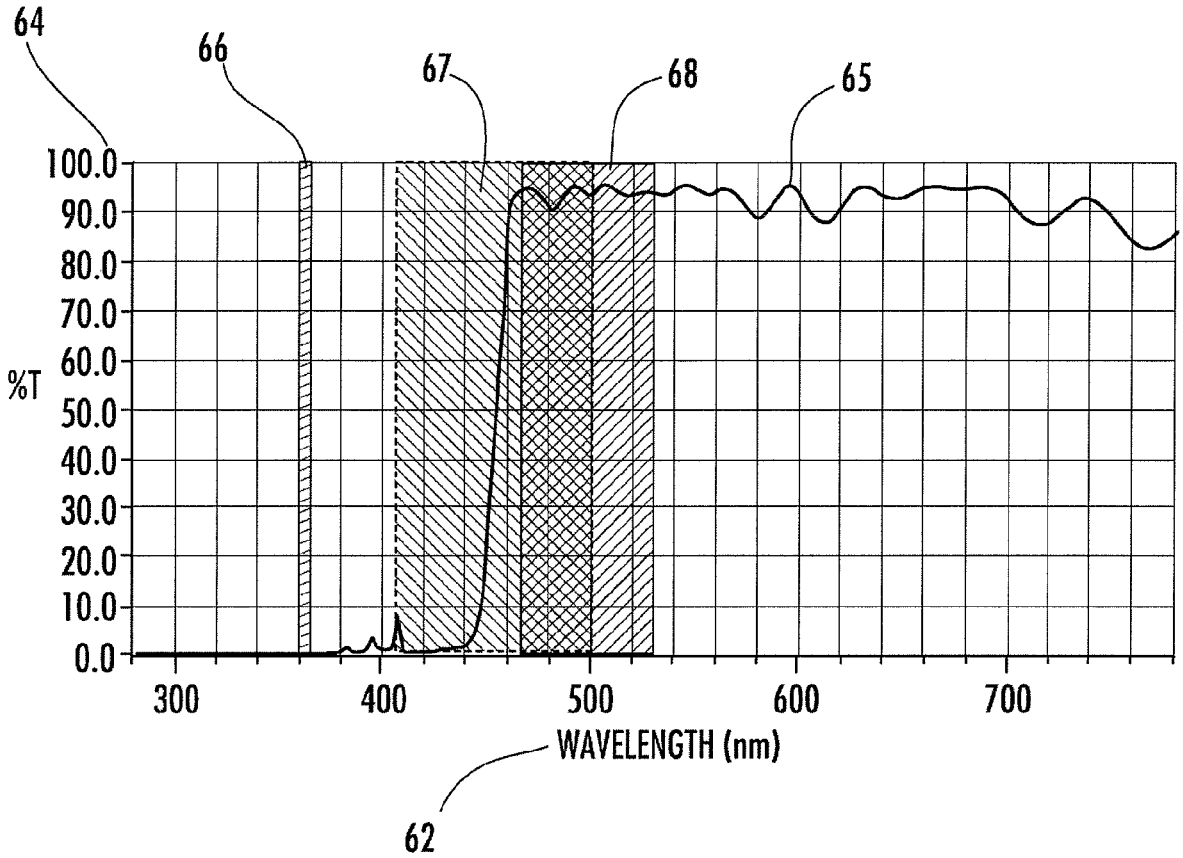
FIG. 6 is a graph illustrating the omission range of optical brighteners.

The transmission curve 65 of the dichroic mirror 55 mounted at 45° to the incident parallel beam is shown in FIG. 6. Percent transmission 64 is plotted against wavelength 62.

The percent reflection curve (not shown) versus wavelength 62 is roughly the inverse of the transmission curve 65. The 50% crossover point of each curve is here designed to be near 450 nm. The Day-Glo D034 fluorophore used in direct thermal media 10 has a broad emission peak with a maximum near 507 nm over some wavelength range 68, and a secondary peak absorption wavelength around 345 nm. This large Stokes Shift of approximately (507–365) nm=142 nm means that a dichroic mirror can be selected that blocks virtually any reflected 365 nm LED excitation light 66 from the returning light path to the CMOS or CCD linear imaging sensor 60.

However, many white papers also incorporate optical brighteners; that is, fluorescent whitening agents that absorb light in the ultraviolet and violet region (usually 340-370 nm) of the electromagnetic spectrum, and re-emit light in the blue region (typically 420-490 nm). Since paper brightness is typically measured at 457 nm, optical brighteners are often used to enhance the visually perceived whiteness of paper by making materials look less yellow by increasing the apparent overall amount of blue light reflected by addition of the blue fluorescent light.

In FIG. 6, the emission range 67 of optical brighteners not only overlaps with the low end of the fluorophore emission range 68, but in addition a significant portion of the optical brightener fluorescence range 67 is above 440 nm, where the dichroic mirror transmits in the optical return path to the CMOS or CCD linear imaging sensor 60. Experimentally, it was found that the linear imaging sensor noise floor in the return path due to optical brightener fluorescence could be a significant percentage of the stripe fluorescence intensity. This strongly affected the accuracy of the registration system, and, in particular, accuracy of detection of the position of either the leading edge or centerline of the fluorescent stripe image on linear imaging sensor 60. Since it may be difficult to filter out this optical brightener fluorescence, it is important in the design of a system according to the present invention and in the manufacture (construction) of direct thermal media 10 that a base paper and constituent chemicals be selected that contain substantially no or, preferably, no optical brighteners that affect the ability of the optical registration system 50 to detect and locate the fluorescent yellow stripes 12 of the media 10.

Fluorescent light emitted from the fluorescent yellow stripes 12 in the excited region on the exposed media 57 passes through lenses 56*a* and 56*b* and is output as a parallel beam impinging on dichroic beamsplitter 55 which efficiently transmits the 507 nm peak wavelength range and blocks any reflected UV. The parallel beam now passes through aspheric lens 58, which has a special curvature to minimize optical aberrations. The now focused beam passes through rod lens 59, which compresses the image along the stripe in the narrow axis of the 512×1 pixel linear imaging sensor 60 mounted inside camera 61.

Figure 7A:
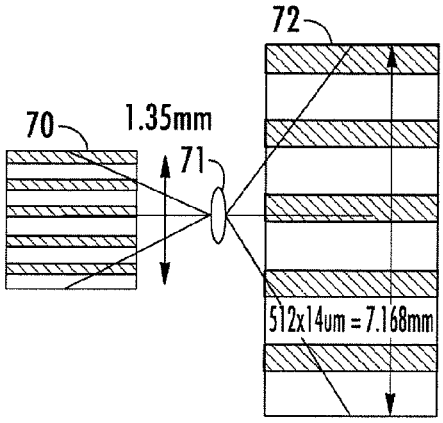
FIGS. 7A and 7B are graphics illustrating the effects of anamorphic optics.
Figure 7B:
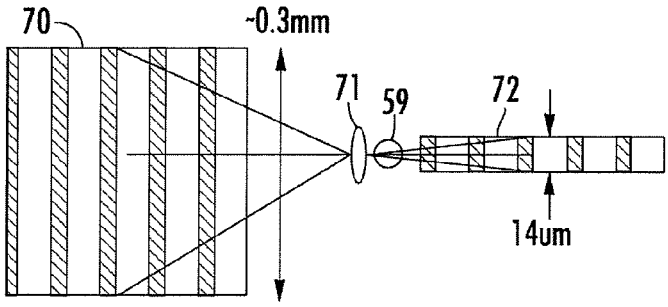

The effects of the anamorphic optics in 50 are shown in FIGS. 7*a* and 7*b*. In FIG. 7*a*, a portion of the striped thermal media 70, which has 5.33 stripe patterns with a pattern repeat distance of 0.010 inches (total length=0.0533 inches=1.35 mm), is magnified −5.3× by lens system 71 to an image length of 512×0.014 mm=7.168 mm on the 512 pixel linear imaging sensor 72. In the embodiment shown in FIG. 7*a*, magnification in this axis is done entirely using spherical and aspherical optical system 71 including planoconvex lenses 56*a*, 56*b*, and aspheric lens 58, but not rod lens 59. Note that a rod lens is a true cylinder lens. Rod lens 59 is oriented so that it does not refract in axis orthogonal to the stripes, thus it does not participate in the magnification in this axis.

In FIG. 7*b*, approximately 0.3 mm of stripe 12 extent on media 70 is compressed to 0.014 mm by the same lens system 71 acting together with rod lens 59 in the orthogonal direction (parallel to the stripes) where the refraction of the 10 mm diameter rod lens 59 participates in the net −0.048× magnification.

Figure 8:
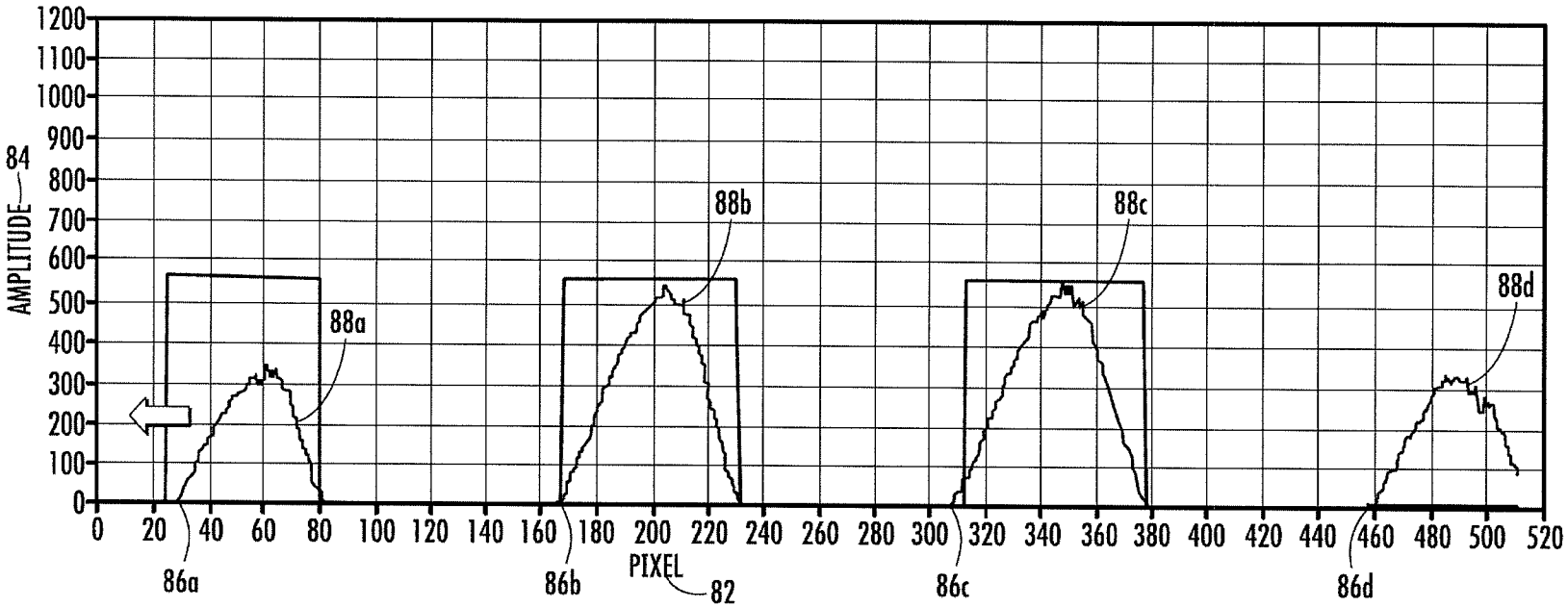
FIG. 8 is a diagram illustrating a digital readout of a pixel linear imaging sensor camera on a digital oscilloscope according to an embodiment of the present invention.

FIG. 8 shows a digital readout of the 512 pixel linear imaging sensor camera 61 on a digital oscilloscope (here using non-standard media with a stripe pattern repeat distance of approximately 0.013 inches). The horizontal axis 82 shows the linear imaging sensor 60 pixel number 0 through 511; the vertical axis 84 is relative fluorescence amplitude of the yellow stripes 12 output on each pixel as converted by a 10-bit analog to digital convertor, set to range in relative output value from 0 to 1023. As the print media (i.e., print paper in this embodiment) moves through the printer, the 4 peaks 88*a-d* appear to march across the screen from right to left, growing in amplitude as they move towards the center and decreasing as they move towards the left edge. This change in peak height with position is because the illuminating UV light intensity is not flat across the paper, but resembles a Gaussian intensity profile across the area seen by the linear imaging sensor 60 with its peak intensity near the center of the illuminated area. The fluorescent intensity falls to near zero or zero between the peaks, as there is substantially no or, preferably, no fluorophore in either the magenta stripes 13 or cyan stripes 12, and there are substantially no or, preferably, no optical brighteners used in the direct thermal media 10.

Image Processing

The image captured by camera 61 is processed by first reading in all 512 pixel amplitude values from linear imaging sensor 60 into the image processing unit (not shown). The image processing goal is to continually (i.e., repeatedly) find the leading edges 86*a-d* of each fluorescence image 88*a-d* corresponding to the up to 4 fluorescent stripes on the media now within the field of view.

Figure 9:
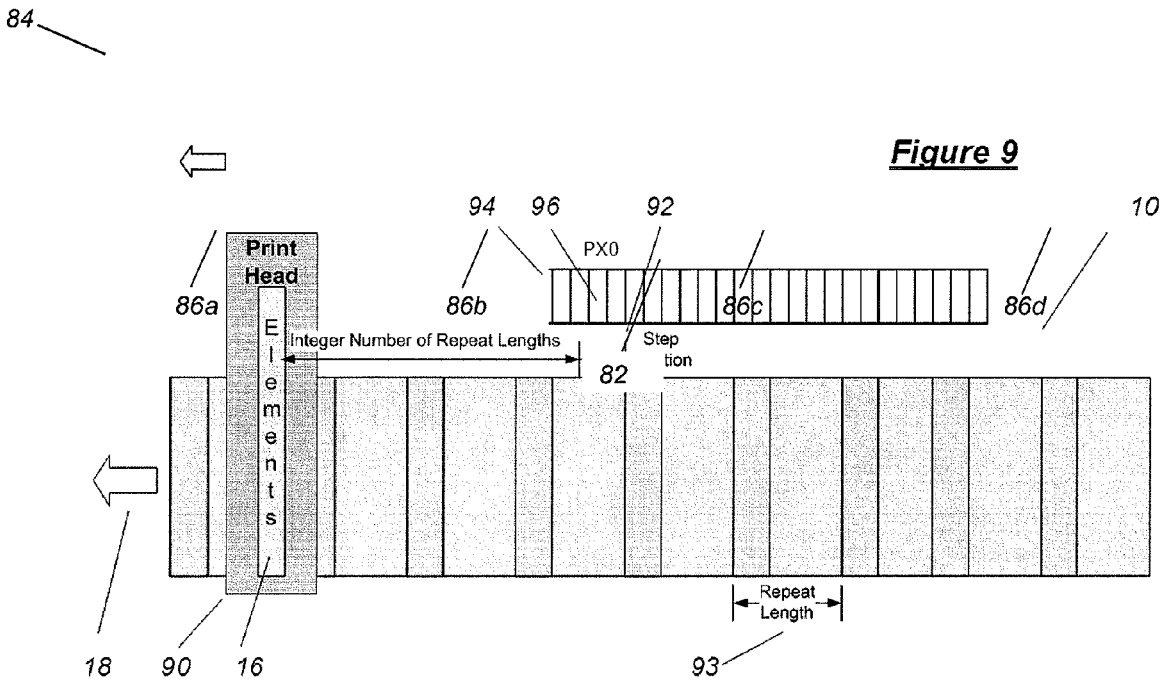
FIG. 9 is a schematic diagram of a direct thermal media under a print head.

To model how this information is used to control registration of the direct thermal media for print operation, in FIG. 9 direct thermal media 10 moving in direction 18 passes under print head 90 having print head element line 16. The leading edge pixel 92 of each fluorescent yellow stripe 12 having breadth 19*a* and repeat length 93 as seen at linear imaging sensor 94 has been previously correlated with the fluorescent yellow stripe position under the thermal print head element line 16, through a calibration cycle. When the leading edge position 92 of the fluorescence peak corresponding to a yellow stripe 12 moves to some previously determined pixel 96 (called PX0), then the yellow stripe 12 is directly under print head element line 16, and a synchronizing signal is output to the external printer control unit (not shown). Printing of all 3 stripes in the stripe group under the print head begins and continues under printer control until finished. The next printing cycle begins when the next stripe group's fluorescence peak moves into registration at PX0.

Figure 10:
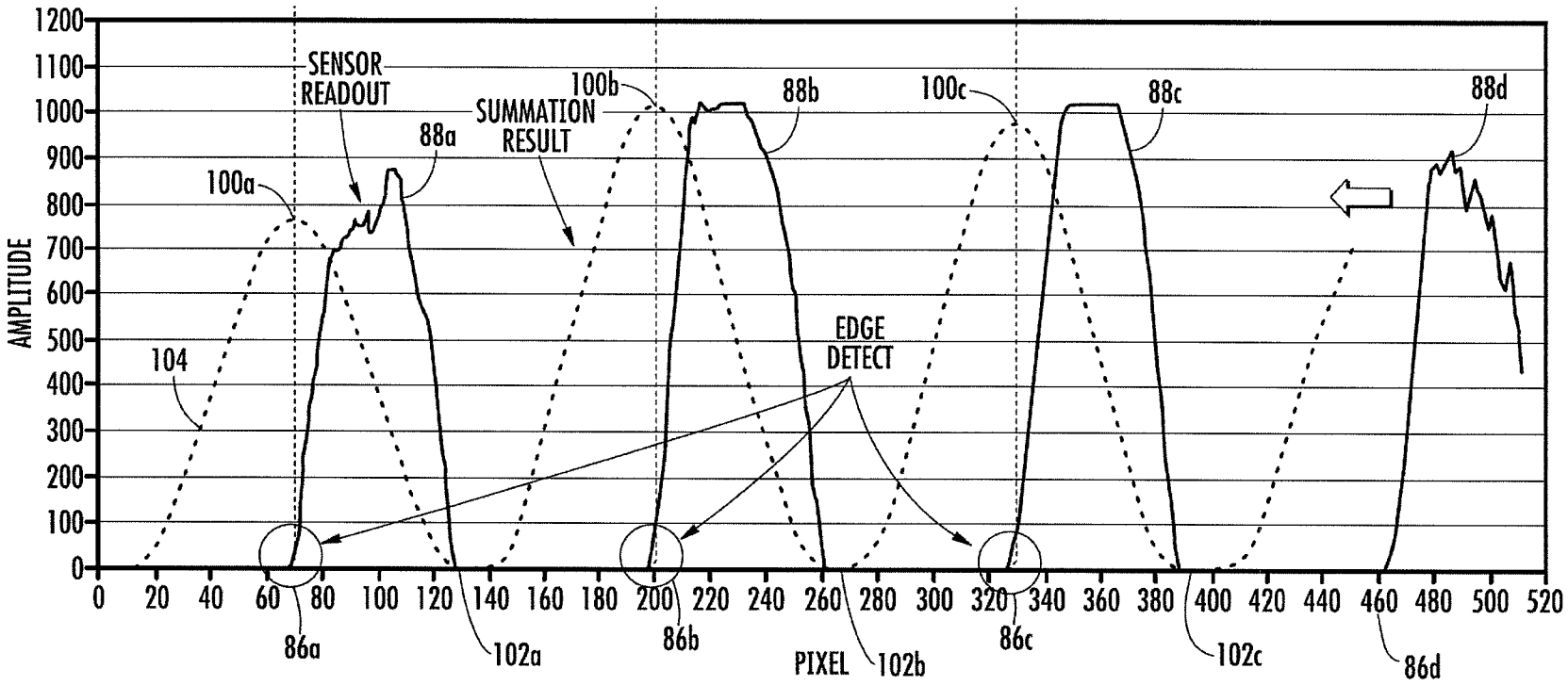
FIG. 10 is a diagram illustrating a digital readout of a pixel linear imaging sensor camera on a digital also scope according to an embodiment of the present invention.

In FIG. 10, the actual image processing steps to detect the leading edges 86*a*, 86*b*, and 86*c* of the three complete stripes 88*a*, 88*b*, and 88*c* a=1/300 inch=0.0847 mm may be seen. These leading edges have been determined, and are shown by the 3 vertical dashed lines. These pixel positions correspond to peaks 100*a*, 100*b*, and 100*c* respectively in roughly sinusoidal curve of values of the summation result SR 104, which is the output of an algorithm for detection of the leading and trailing edges of each fluorescent intensity curve. Where the SR 104 returns to zero determines the trailing edges of the peak 102*a*, 102*b*, and 102*c* respectively.

The summation result algorithm used here employs here a sliding integration window of w=60 pixels with w selected on the order of the expected number of pixels containing a valid fluorescence signal from a stripe 12 of breadth a=1/300 inch=0.0847 mm. This particular method offers good immunity against detecting local spurious peaks and asymmetric peaks caused by printing defects. It also is simple enough to be implemented in a single-chip microprocessor, FPGA, or DSP.

Let $RD_j$ be the raw data for the jth pixel and $SR_i$ be the summation result for the window of width w pixels starting at pixel i and extending through pixel (i+w). Using c as an arbitrary scaling constant, $$SR_i = c\sum_{i}^{i+w} RD_j \text{ for } i = 0, 1, 2, 3\ldots, (511-w) \tag{11}$$

The values of $RD_j$ return to zero between peaks, when there is preferably no fluorescence emitted by the magenta stripes 13 or cyan stripes 14, and optical brighteners are preferably not present in media. The next step is to detect the slope of SR 104 to detect both peaks and returns to zero, corresponding to the leading and trailing edges of the fluorescence peak. The slope $SL_i$ at pixel position i is given by the difference in SR over (2n+1) pixel positions:

$$SL_i = k(SR_{i+n} - SR_{i-n}) \text{ for } i = n, (n+1), \ldots, (511-n) \tag{12}$$

Here k is an arbitrary scaling constant and here n=2. Larger values of n produce additional smoothing, but SR is already heavily smoothed by the 60 pixel integration window. The leading edge of each peak is detected by the pixel j at which $SL_j$ crosses zero from positive to negative values. Since the two adjacent values have opposite signs, the pixel value j is selected on the basis of the smaller value of absolute value of SR. The trailing edge is taken as the point at which $SL_j$ goes from negative to zero. Here, the accuracy of the trailing edge is less important, as only the leading edge is used for registration control in the described embodiment.

For the three complete peaks 88*a*, 88*b* and 88*c* in FIG. 10, the SR and SL algorithms applied to data shown in FIG. 10 give the following results for media 10 with a=1/300 in=0.0847 mm:

TABLE 1

| Peak | Leading Edge Reference # | Leading Edge Pixel # | Trailing Edge Reference # | Trailing Edge Pixel # | Nominal Peak Width, in Pixels |
|---|---|---|---|---|---|
| 1 | 86a | 68 | 98a | 130 | 62 |
| 2 | 86b | 198 | 98b | 263 | 65 |
| 3 | 86c | 327 | 98c | 390 | 63 |

The repeat length, RL, is defined as the average distance between leading edges 86*a*, 86*b* and 86*c* and corresponds to the extent of each 3 stripe group across the CCD pixels. Preferably, the stripe 12 containing the fluorophore has a peak width in pixels equal to ⅓ of the repeat length in pixels, as the cyan and magenta stripes contain substantially no or, preferably, no fluorophore. Printing tolerances and optical aberrations may cause this to vary, so it was found effective to calibrate pixel position PX0 with the leading edge of the fluorescent yellow stripe under the print head and then trigger each printing cycle and assume that each stripe is ⅓ of RL in pixel width. In this embodiment, each pixel is 1/9600 inch and each motor microstep is 1/4800 inch in direction 18.

Thermal Printer Operations

FIG. 11 shows a block diagram of an exemplary thermal printer 110 designed to print using the exemplary embodiment of direct thermal media 10 described herein. Printer 110 includes a communications port 111, main processor 112, main memory 113, bitmap memory 114, power system 115, and the printing mechanism includes platen roller 117 driven by drive motor 118; together with optical registration system 50, all mounted in housing 119. Bitmap memory 114 may be an area within main memory 113, or stored in a separate hardware memory device such as a field programmable gate array (FPGA).

The main processor is connected via bus 302 to communications port 111 and bus 303 to memory 113. Main processor 112 can execute the main control program 116, execute the label format rendering program 321, and manage the communications port 111 to download label formats 320. Main control program 116, format rendering program 321, and label formats 320 are all stored in main memory 113. Label formats may be created as any renderable image, whether it be for labels or RFID smart labels, documents, receipts, tags, tickets, wristbands, cards, or printed components, and may be described in any formatting language including printer languages, such as ZPL, CPCL, EPL, IPL or APL-I, EPOS, DPL or APL-D, Postscript or PCL, a defined image or bitmap, including .bmp, .tiff, or .jpg images, or a markup language such as HTML, XML, RSS, or an XML schema.

A color label format 310 written in the label formatting language used by printer 110 is transmitted over link 301 to communications port 111 and stored in main memory 113. The label format rendering program 321 is then used to convert the format instructions into dot line data streams for color bitmap data and black bitmap data, which are stored as two separate bitmap planes within bitmap memory area 114. Each memory bit corresponds to 1 printed pixel along one print head element line. When the pixel is not printed, the corresponding bit in both the color plane and the black plane are set to "0". When the pixel is to be printed black, the corresponding bit in the black plane bitmap is set to "1". When the pixel is to be printed as a color, the corresponding bit in the color plane bitmap is set to "1", and "0" is set in the corresponding bit in the black plane bitmap. Since the color stripes on the label are adjacent and do not overlap, a single color plane suffices to hold the print line pixel values for all 3 colors cyan, magenta, and yellow.

Main control program 116 uses subsystem 203 to connect to the camera 61 in the optical registration system 50 and command the readout of linear imaging sensor 60, which is transmitted over interface 304 to registration processing subsystem 203. Camera 61 and linear imaging sensor 60 are described with respect to and shown in FIG. 5. Motion control subsystem 204 is connected via interface 305 to drive motor 118. Print head control subsystem 202 is connected via interface 306 to print head 90. These 3 logical subsystems 202, 203, and 204 may be subroutines within main control program and/or hardware logic within an FPGA, and all are operated under the control of printing process sequencing subroutine 201 which in turn is managed by the main control program 116 run by main processor 112.

FIG. 12 shows the printing sequence program 201 of FIG. 11 expanded to show steps in the printing of each three color stripe group 12, 13, and 14 and their underlying black flood coat on thermal media 10. Print process sequencing program 201 reads the output of registration processor subsystem 203 and synchronizes the selection of print lines by print head controls in the bitmap memory 114 with the line position on the label format being printed. Registration processor subsystem 203 continuously processes the position of the yellow lines in the CCD as described with respect to FIG. 10 and outputs the result to process 122, which microsteps the media 10 at process 123. When the fluorescence peak is found to be at position PX0 in FIG. 9, process 122 sends a message to decision 124 to commence the printing of the next group of yellow 12, magenta 13, and cyan stripes 14. Since a 600 dpi print head is utilized in the exemplary embodiment, each 1/300 inch stripe consists of two 1/600 inch print lines, each corresponding to eight 1/4800 inch microsteps. In the normal case, a stripe group totals 48 microsteps or 0.0100 inches.

Decision 124 is put in to deal with the foreshortened case when the group repeat distance is less than 48 microsteps due to manufacturing errors in media 10. In this case, any active print cycle is reset by process 126 to correspond to the detection of the start of a new stripe group. In both cases, a new group print cycle is initiated by process 125. In both the normal and the foreshorten cases, in process 127 the bitmap pointers are set to point to the print line corresponding to the start of the next yellow line data. In the overlong case where the actual group repeat distance is greater than 48 microsteps, the bitmap pointer is forced by process 127 to the correct position in the color and black bitmaps. Therefore, at the end of process 127, both the color and black bitmap pointers to memory 114 are set to the position of the first line of yellow and black pixel data for the new stripe group to be printed.

The print head control logic 202 is activated by delivery from process 401 of color bitmap line data and black bitmap line data for that same line. Process 402 evaluates the two bitmap values for each print head element in 16, and, if the color bit is set, sets that print head elements to print energy $E_c$, and, if the black bit is set, then sets that print head element to print energy higher energy $E_b$. Adjustments to the individual print head element 16 energy settings may be made during process 402 to compensate for the heat history of that element and/or neighbor element effects. Process 403 then causes the entire print head 90 to be loaded and activated, with each print head element 16 activated at its predetermined energy.

Processes 404, 405, and 406 form a loop to send out up to 8 microsteps to preposition the media to the next line. At the start of each cycle process 405, which is functionally identical to process 122, checks to see if we have the foreshortened case of less than 48 microsteps and goes to process 122 if so via connector B. Decision 406 determines if the paper has moved 8 microsteps, and, if so, process 407 increments the color and black bitmap pointers to the next print line. If in decision 408 less than all six lines for the stripe group have been printed, then the program loops back to process 401 to print the remaining lines in that stripe group.

If in decision 408 all six lines have been printed, then decision 409 checks to see if the format continues, and, if so, the program loops to connector A and searches for the start of the next stripe group. In the normal case the stripe is already in position in 122. If the format has ended, print termination end action is performed by process 410 which typically includes stewing the media to the start of the next label.

Interlabel Gap Compensation

Two important operational situations must be dealt with when printing die cut labels concerning interlabel gaps, where the direct thermal media has been removed between adjacent labels during the die cutting process. The first is the situation when registration system sensor 17 is either viewing partially on the interlabel gap and partially on the pattern on either the leading or trailing edge of a label. The second situation is when the sensor view is entirely within the interlabel gap, and no fluorescent yellow stripes 12 are seen, causing loss of registration control by that sensor. In both cases, loss of registration control can be avoided by using two optical registration systems of the type 50, offset by greater than one maximum interlabel gap distance, b, as shown in FIG. 13, with the image processing unit switching control between them as required to ensure that one sensor always has 4 fluorescent yellow stripes in its field of view.

Figure 13:
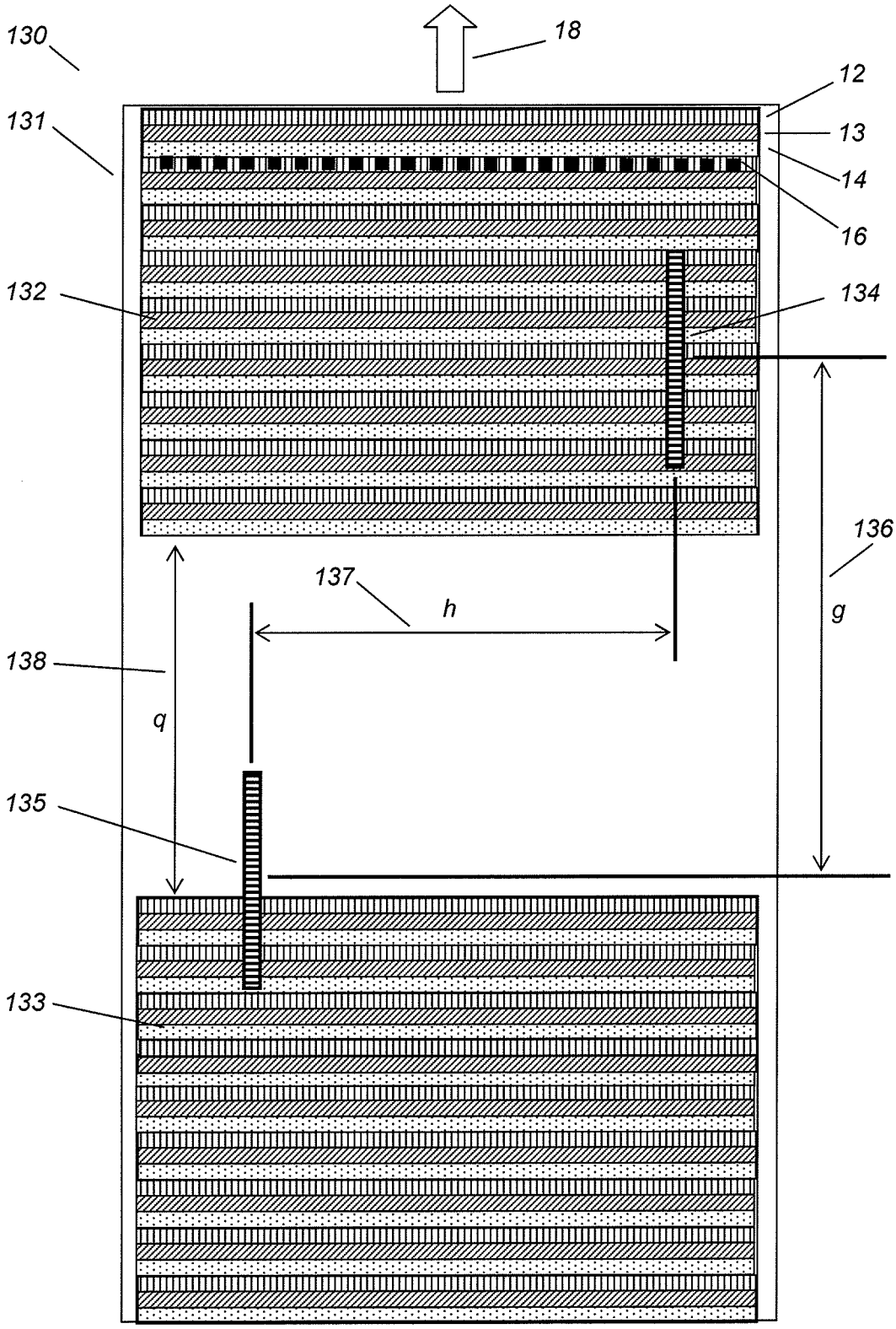
FIG. 13 is a diagram of a laterally striped direct thermal media with interlabel gap according to an embodiment of the present invention.

In FIG. 13, media web 130 is shown comprising release liner 131 carrying self-adhesive labels 132 and 133, each made using striped thermal media 10. There are two registration sensors of the type defined by 50; shown are the fields of view of primary sensor 134 and secondary sensor 135. Primary sensor 134 is located as close as possible behind the print head, which has print element line 16. The two sensors centerlines are separated by distance g along the web 136 and distance h across the web 137. Note that distance g along the web 136 is greater than q, the maximum interlabel gap 138. Supplies for this system are preferably specified to have a maximum interlabel gap q 138 less than the distance g 136 designed into the printing system.

This sensor arrangement ensures that one sensor 134 or 135 is always viewing the fluorescence from four yellow stripes 12 in the laterally striped direct thermal media 10 and, thus, in control of the registration system and print head management. Normally, this control is performed by the primary sensor 134, but passes to the secondary sensor 135 during the period that the interlabel gap 138 is passing under primary sensor 134, and less than 3 stripes are in its field of view. Control may pass back to the primary sensor 134 when it again has 4 fluorescent yellow stripes in its field of view.

Label Skew Compensation

Figure 14A:
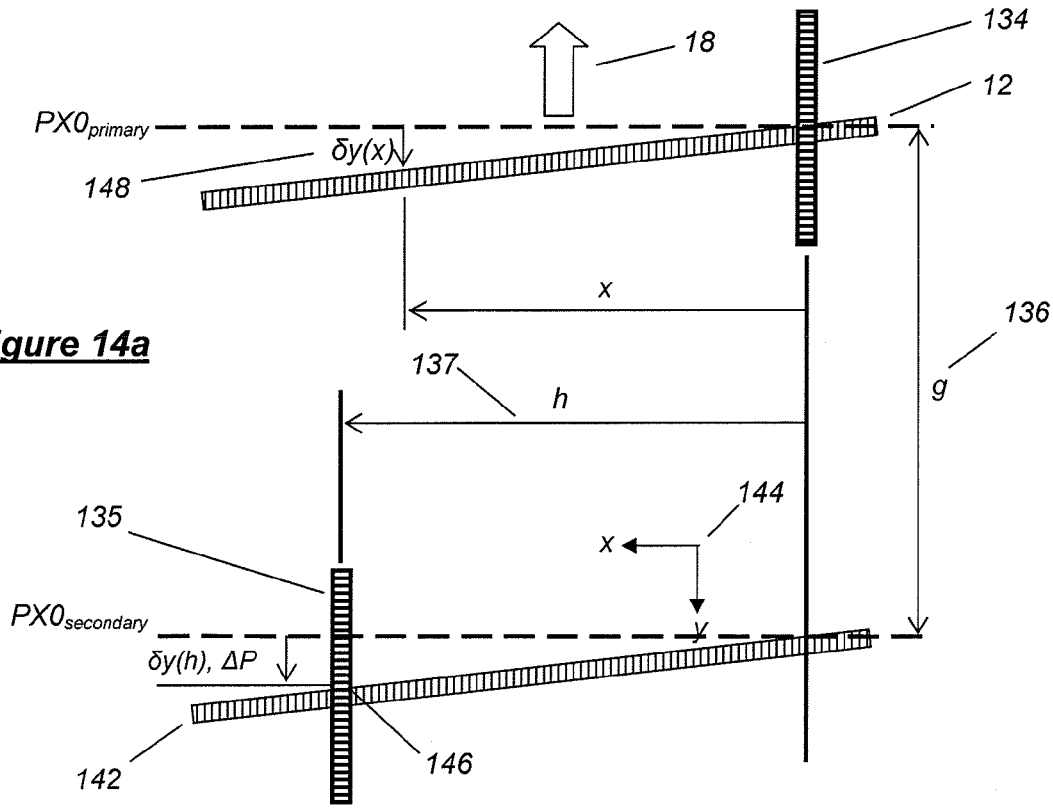
FIGS. 14A and 14B are diagrams illustrating label skew.

In FIG. 14*a*, by placing both the primary sensor 134 and the secondary sensor 135 on opposite edges of the label media at a known lateral offset h 137 and set apart along the web at lineal offset distance g 136, label skew of the color stripes 12, 13, and 14 in the thermal media 10 with respect to the print head element line 16 can be determined and compensated. Skew compensation can be by rotation of the print head so that the print head element line 16 aligns with the media 10; rotation of the media transport and sensor system to align the media 10 with the print head element line 16; and/or by electronic means in systematic delay of firing print head elements until the portion of the stripe to be imaged on the moving media 10 actually reaches the appropriate print head elements, or some combination thereof.

Referring to FIG. 14*a* and the illustrated definition of axes 144, skew of the yellow and fluorescent lines 12 relative to the cross web x-axis will result in a measurable offset distance δy(x) 148 along the web y-axis, which will result in a detectable sensor pixel delay offset ΔP to $PX0_{secondary}$ in the secondary sensor 135. Because of the repeating stripe pattern, the maximum skew that can be compensated for is $0<\Delta P<RL$, where RL is the repeat length defined above.

In FIG. 14*a*, the skew is such that the offset ΔP to $PX0_{secondary}$ 142 is in the direction +y as defined by axes 144. The offset ΔP to $PX0_{secondary}$ delays the leading edge of the fluorescent line crossing the secondary sensor 135 at a point 146, occurring later in time at shift register position ($PX0_{secondary}+\Delta P$).

To compensate electronically for the skew and offset distance ΔP, the printing control routines in the printer can generate different print head element firing delays δt(x) at different points x along the print head element line 16, if the print head supports this function. This results in more accurate printing of the print line dots on the stripe in the presence of media skew. However, it may cause distortion in printed fonts, bar codes, and graphic images.

The algorithm for this case of skew compensation is driven by the primary sensor system 134. Once the leading edge of the fluorescence peak is detected at $PX0_{primary}$ the firing delay δt(x) for each print head element (or more typically, groups of adjacent elements) comprising the print line 16 at distance x from the primary sensor 134 are then adjusted proportionally according to their apparent position lag or gain δy(x) 148. From proportional triangles, $$\frac{\delta y(x)}{\delta y(h)} = \frac{x}{h} \tag{13}$$

And at constant paper speed V the time intervals are similarly proportional:

$$\frac{\delta t(x)}{\delta t(h)} = \frac{x}{h} = \frac{\delta t(x)}{\Delta t} \tag{14}$$

Here ΔP is known to be given in units of 1/9600 of an inch, so the time interval Δt to move distance adjusted for the print speed V, in inches per second:

$$\Delta t = \frac{\Delta P}{9600V} \tag{15}$$

For example, if ΔP=10 pixels then the physical skew distance δy(x)=ΔP/9600=0.0010 inches. At a constant print speed of V=4.0 inches per second Δt=ΔP/(9600×4.0)=260 μs.

Combining equations (14) and (15) and solving for the firing delay, δt(x) is adjusted for the print speed V in inches per second the skew firing delay for a print head element at position x is:

$$\delta t(x) = \frac{x\Delta P}{9600\,hV} \text{ in seconds.} \tag{16}$$

In the example where ΔP=10 and V=4.0 then δt(x)=260x/h microseconds.

Figure 14B:
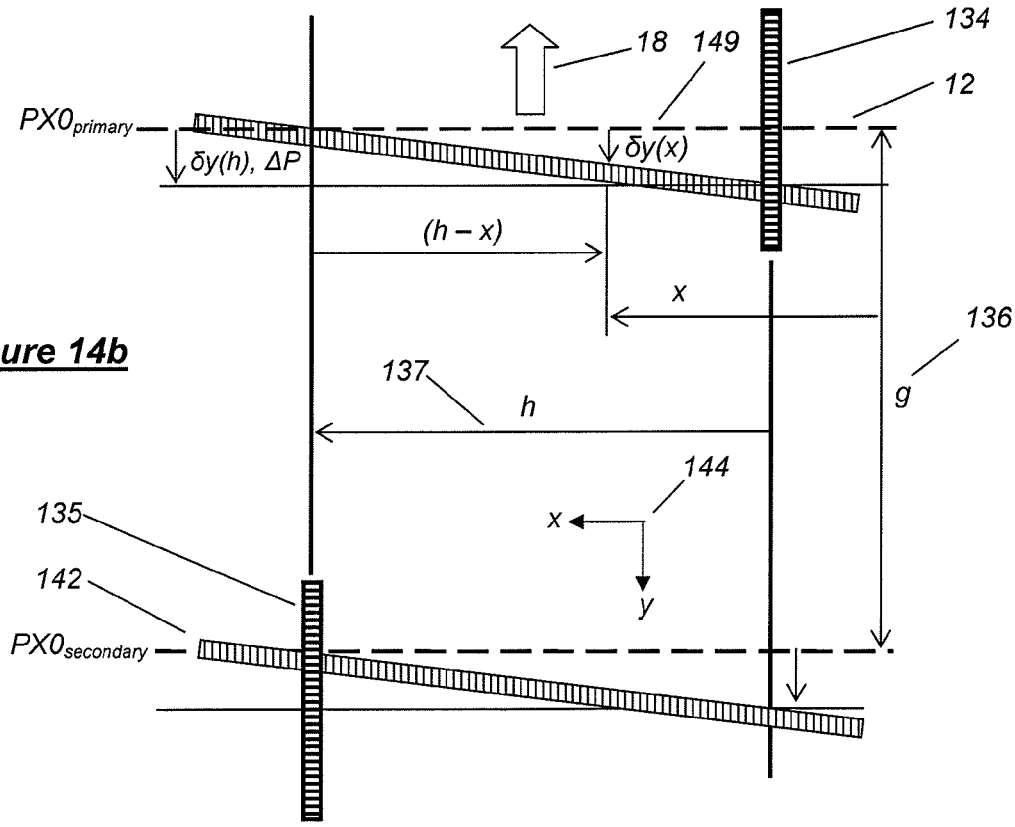

The algorithm is only slightly different for the case of skew δy(x) 149 in the −y direction, as shown in FIG. 14*b*. The algorithm for this case of skew compensation is still driven by the primary sensor system 134. If skew is compensated for in terms of firing delay, once the leading edge of the fluorescence peak is detected, the elements at x=h are fired, and the firing of elements to the right are delayed proportionally to (h−x), so that in this case δt(x) can easily be shown to be:

$$\delta t(x) = \frac{(h-x)\Delta P}{9600hV} \text{ in seconds.} \tag{17}$$

Media Calibration

To account for media offset, such as expanding and contracting direct thermal media 10 due to humidity and/or changes in paper moisture content, as well as manufacturing tolerances, an entire label, ticket, tag, receipt, or document may be scanned. The leading edge of the label may be determined by a similar pattern of one, then two, then three, then four fluorescent stripes 12 in the view of primary sensor 134. The number of patterns may be accumulated over the length of the label. Similarly the trailing edge of the label may be determined by a similar pattern of four, then three, then two, then one fluorescent yellow stripes 12 in the view of primary sensor 134.

Calculations may then be made on the accumulated data by the image processing unit. For example, the measured fluorescence peak value can be used to set the electronic gain or shutter time of the linear imaging sensor 60 to obtain a preferred fluorescence signal and a preferred value of the constant c used in calculating SR in equation (11) above, determine the average fluorescence peak width in pixels to allow estimating of the summation window width w to use in equation (11), and determine the average repeat length RL in pixels to use in control of the actual printing process. The number of fluorescence stripes estimates the label length. Comparing this to the known label length from the manufacture may also minimize the chance of error due to media slip during calibration.

A second calibration process may be used to determine PX0, the pixel position in the linear imaging sensor 60 where the print cycle for the 3 stripe group is initiated when reached by the leading edge of the fluorescent yellow stripe 12. Start by printing the stripe under the print head with PX0=0, then dispense the printed media a known distance for visual inspection. If not the correct color (yellow), increment PX0 and try again. Continue until the yellow stripe is clearly printed. Then confirm by printing a length of media with only the yellow stripes printed or a similar pre-determined print sequence for inspection. Record the value of PX0 found. If two registration sensors are in use, perform the calibration cycle separately and determine both $PX0_{primary}$ for the primary sensor 134 and $PX0_{secondary}$ for the secondary sensor 135.

This calibration can also be performed automatically on media containing optional flood-coated black by first thermal transfer printing a narrow black ink line on the fluorescent yellow stripe 12 which obscures a portion of the fluorescence and then rerunning the printed media through the printer and detecting two narrow peaks in the primary sensor. By printing several trials at slightly different locations on the yellow stripe, the optimal printing position can be located and recorded.

Print Head Rotation

Media skew and web weave can be caused by a number of factors, such as expansion and contraction due to temperature or humidity, tooth alignment on drive and guide sprockets, tooth size on drive and guide sprockets, tension between drive and guide assemblies, tension between the drive assembly and the thermal print head, tension between the thermal print head and the guide assembly, fluctuations in hole sizes in the media, media hole deformations, and/or sprocket shaft alignment and wobble. All of these factors lead to a desire to compensate for media skew and web weave.

Figure 16:
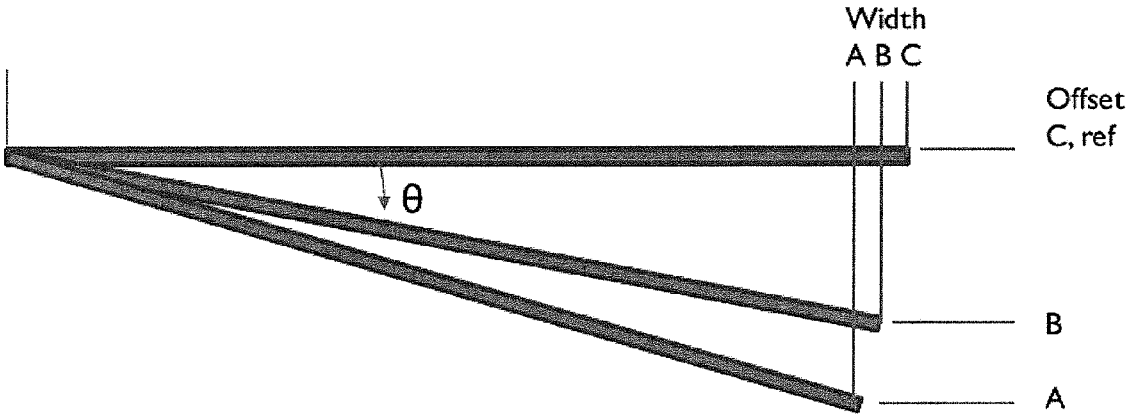
FIGS. 16 and 17 are diagrams illustrating label skew and displacement.

As described above, one method for compensating for label skew, such as from paper expansion or contraction caused by humidity change, is rotation of the print head to match the media line pitch with the print head heater element pitch. FIG. 16 is another illustration of media skew. Exemplary expansion and contraction due to humidity changes are presumed to be limited to ±1%. Position A is illustrated in the 1% contracted state of the media. Position B is illustrated in the nominal state of the media. Position C is illustrated in the 1% expanded state of the media. Additional measurements for Positions A, B, and C, are presented below in Table 2 for a 600 dpi print head 4.000 inches long.

TABLE 2

| Media State | Position | Line Pitch (in) | Horiz LPI | Angle θ | Offset* y | Width* x |
|---|---|---|---|---|---|---|
| Contracted 1% | A | 0.99/(1.01 · 300) | 306.061 | 11.421° | 0.7921 in | 3.9208 in |
| Nominal | B | 1.00/(1.01 · 300) | 303.000 | 8.069° | 0.5615 in | 3.9604 in |
| Expanded 1% | C | 1.01/(1.01 · 300) | 300.000 | 0.000° | 0.0000 in | 4.000 in |

In the situation of FIG. 16, the media is print at a nominal 300 dpi×1.01-303 dpi. When the media expands 1%, the minimum pitch is adjusted and set to 1.01/303 dpi or 300 dpi. When the media contracts 1%, the maximum pitch is adjusted and set to 0.99/303 dpi or 306.061 dpi. The print head may be rotated to change the effective cross web print resolution from 300 dpi to 306 dpi to match the media line pitch.

Figure 17:
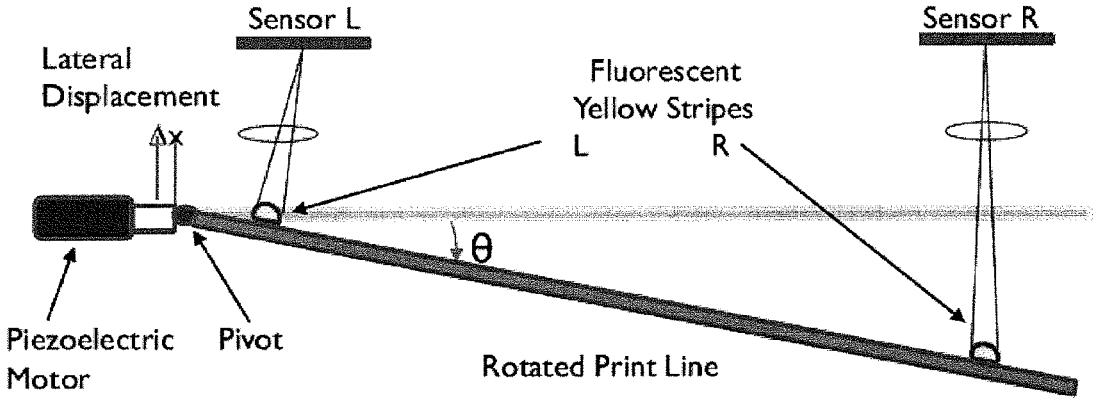

FIG. 17 illustrates a lineal media tracking system that may be employed to address lateral displacement and rotation of print line. A linear CMOS sensor L may detect the position of a fluorescent yellow stripe L near the left edge of the media. Any lateral displacement may be compensated for by causing a piezoelectric motor to move the print head assembly Δx, keeping stripe L under the same two print head dots. A fast acting automatic control system may be employed to address lateral displacement during printing operations.

A linear CMOS sensor R may detect any gross changes in the expansion or contraction of the nominal media width. The print head rotation angle θ may be adjusted, keeping stripe R centered under the same two printhead dots. If media width change is sufficiently slow, this rotation could be a manual adjustment, although an electronically controlled motor may be preferable.

Figure 18:
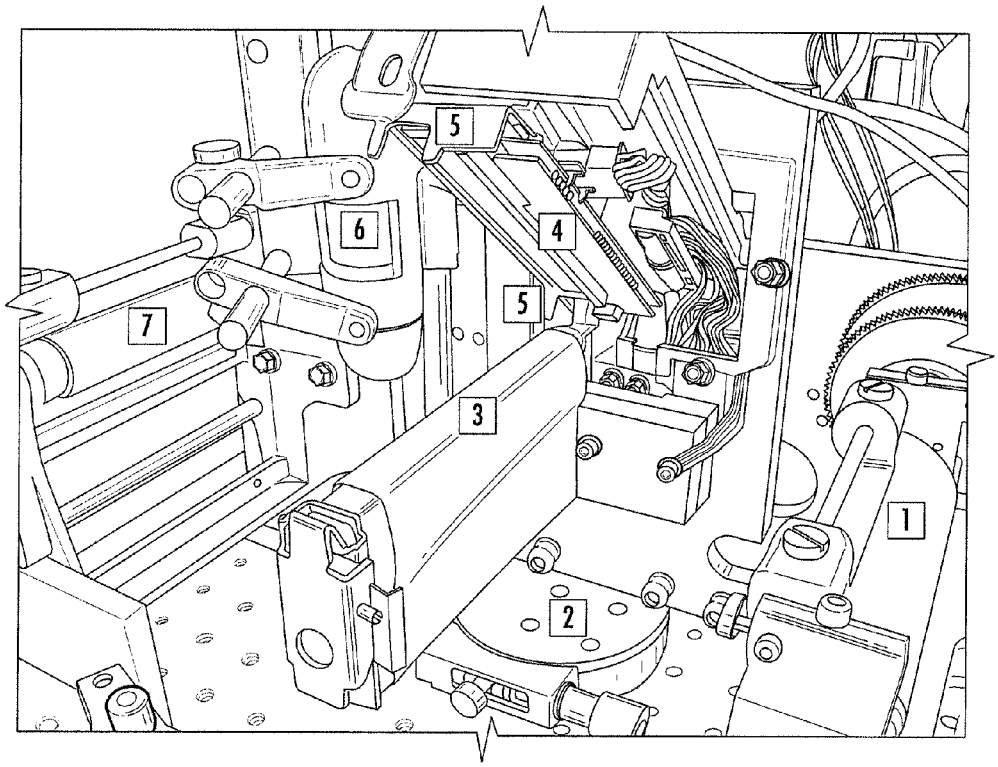
FIG. 18 is a pictorial illustration of a thermal printer using a direct thermal media registration system of embodiment of the present invention.

FIG. 18 is a pictorial illustration of a thermal printer using a direct thermal media registration system of embodiment of the present invention. A sprocket drive assembly 7 and sprocket guide assembly 1 operate to respectively drive and guide a direct thermal media through the thermal printing system including a thermal print head 4 and adjacent surface 3 bounded by alignment forks 5. The entire printhead mechanism is mounted on a micrometer-driven rotation stage 2 to enable precise alignment between the print head heater element in media line pitches. Surface 3 may include a low friction cover, such as siliconized paper or Teflon film over a compressible foam, to provide a uniform pressure between the thermal print head and the media over an angular range, such as over a range of at least 12°. Motion of the media may be monitored by a video microscope 6, such as to record video clips up to 30 seconds in duration. Lateral web weave can be tracked using the recording feature of video microscope 6 and a second microscope (not shown), corresponding to sensors L and R in FIG. 17.

Many modifications and other embodiments of the inventions set forth herein will come to mind to one skilled in the art to which these inventions pertain, upon having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A system for use in a color direct thermal printer comprising:

a laterally striped direct thermal media comprising a repeating alternating pattern of at least 2 sets of stripes, wherein each stripe set contains a thermochromic leuco dye producing one color when thermally imaged, wherein each of the other stripe sets contain a thermochromic leuco dye producing a unique and different color when thermally imaged, and wherein at least one stripe set also contains a fluorophore and is fluorescent under excitation light of a defined wavelength range;

an optical registration system configured to correspond with the optical properties of the fluorophore and comprising a confocal excitation light source configured to cause the fluorophore carrying stripe to fluoresce with an anamorphic optical return path to filter and focus the emitted fluorescence light pattern by the fluorescent stripe as an image on an array sensor; and an image processing unit configured to determine the position of each fluorescent stripe on the array sensor and configured to output a signal when a fluorescent stripe is detected at a predetermined position on the array sensor.

2. A system as in claim 1, where the optical registration system utilizes an excitation light source which is a solid state laser or light emitting diode with an emission wavelength below 400 nm.

3. A system as in claim 1, where the optical registration system utilizes a solid state sensor for edge position detection of single stripe.

4. A system as in claim 3, where the optical registration system utilizes a linear CMOS or CCD imaging sensor having at least 128 pixels as the sensor.

5. A system as in claim 3, where the optical registration system is configured with an anamorphic optical return path to filter and focus the emitted fluorescence light pattern by the fluorescent stripes as an image on the array sensor and is configured with a magnification in one axis along the sensor >1.00 in absolute value and a magnification in the orthogonal sensor axis <1.00 in absolute value.

6. A system as in claim 1, where two optical registration systems are utilized in tandem with a common image processing unit, and the two optical registration systems are spaced apart both along and across the media web.

7. A system as in claim 6, where the two optical registration systems are configured to measure media skew and where the system is configured to use the measure of media skew to rotate the print head line to eliminate skew by aligning the print head line with the media stripes.

8. A system as in claim 6, where the two optical registration systems are configured to measure media skew and where the system is configured to use the measure of media skew to rotate the media transport system to eliminate skew by aligning the media stripes with the print head line.

9. A system as in claim 6, where the two optical registration systems are configured to measure media skew and where the system is configured to use the measure of media skew to delay the firing of each print head element or a group of print head elements until the skewed stripe is near or directly under that element or group of print head elements.

10. A system as in claim 6, where the system is configured to use information regarding the bitmap to be printed to control the printing of barcodes.

11. A system as in claim 1, where the optical registration system comprises two cylindrical lenses and a dichroic beam splitter.

12. A method of aligning a direct thermal media in a printing system, the method comprising:

passing a media by the optical registration system, wherein the media comprises a repeating pattern of two or more stripes which, when thermally imaged, display different human visible colors and at least one stripe of which contains a fluorescing material that is fluorescent under excitation light of at least one defined wavelength, wherein the repeating pattern of two or more stripes is repeated a plurality of times over the media, and wherein the at least one stripe containing the fluorescing material is repeated, with the repeating pattern of two or more stripes, the plurality of times over the media;

exciting a light source corresponding to the at least one defined wavelength of the fluorescing materials to produce an excitation light of the at least one defined wavelength;

imaging at least one stripe of the repeating pattern containing the fluorescing material on a sensor coupled to an image processing unit;

determining, by the image processing unit, the position of the at least one stripe of the repeating pattern containing the fluorescing material that is imaged on the sensor; and signaling a control of a print head in the printing system relative to a position of the media in the printing system for printing the media based upon the determined position of the at least one stripe of the repeating pattern containing the fluorescing material that is imaged on the sensor.

13. A method as in claim 12, wherein the signaling compensates for an interlabel gap of the media.

14. A method as in claim 12, wherein the signaling compensates for a lateral offset skew of the media.

15. A method as in claim 14, wherein the control of the print head comprises rotation of the print head to compensates for the lateral offset skew of the media.

* * * * *